US005352188A

United States Patent [19]

Vitko

[11] Patent Number: 5,352,188

[45] Date of Patent: Oct. 4, 1994

[54] COMBINED BACK AND NECK STIMULATOR AND REHABILITATION DEVICE

[76] Inventor: David M. Vitko, 973 Fairfield Ave., Columbiana, Ohio 44408

[21] Appl. No.: 13,620

[22] Filed: Feb. 4, 1993

[51] Int. Cl.[5] ..... A61H 15/00

[52] U.S. Cl. ..... 601/128; 601/115

[58] Field of Search ..... 601/115, 122, 124, 128, 601/131, 132

[56] References Cited

U.S. PATENT DOCUMENTS

| | | | |
|---|---|---|---|
| 1,748,425 | 12/1927 | Odell | 128/57 |
| 2,619,957 | 2/1950 | Hague | 128/57 |
| 3,205,887 | 1/1963 | Henry . | |
| 3,709,047 | 1/1973 | Zaruba . | |
| 4,233,966 | 11/1980 | Takahashi . | |
| 4,347,838 | 9/1982 | McCauley . | |
| 4,374,519 | 2/1983 | Stauft . | |
| 4,688,556 | 8/1987 | Keller . | |
| 4,712,539 | 12/1987 | Kim . | |
| 4,796,616 | 1/1989 | Panahpour . | |
| 5,005,560 | 4/1991 | Quam et al. . | |
| 5,094,225 | 3/1992 | Craw . | |

FOREIGN PATENT DOCUMENTS

| | | | |
|---|---|---|---|
| 2323851 | 11/1974 | Fed. Rep. of Germany | 128/57 |
| 579719 | 8/1924 | France | 128/57 |
| 1662556 | 7/1991 | U.S.S.R. | 128/57 |

OTHER PUBLICATIONS

The Back Machine 1 page attached.

*Primary Examiner*—Robert A. Hafer
*Assistant Examiner*—David J. Kenealy

[57] ABSTRACT

A small lightweight yet strong frame (12): housing multiple flexible axles (22): which in turn support foam rubber roller balls (16): which roll about an axis creating massage, intersegmental traction, trigger point therapy, and active exercise to the back of the user. These axles (22); are made more efficient by the placement of bushings (26) where they are contained by frame (12). Foam rubber balls (16) contain sleeves (30) which promote free rotation. Neck roller balls (18) are also used to facilitate optional concommitant neck and back treatment. A head rest (38) is provided for comfort and multiple tension adjustments (46) (36) are provided for varying resistance to glide.

10 Claims, 5 Drawing Sheets

COMBINED BACK AND NECK STIMULATOR AND REHABILITATION DEVICE

BACKGROUND—FIELD OF INVENTION

This invention relates to a combined back massage, intersegmental traction, trigger point stimulation, and active rehabilitation device. More specifically to that which is self administered, portable, compact, and economically built.

BACKGROUND

Chiropractors, physical therapists, and massage therapists have long recognized the benefits of intersegmental traction, trigger point stimulation, massage, and active muscle rehabilitation in treating various back and neck related problems. Although these treatments are known to be highly effective in pain relief, they can be very expensive. These forms of treatment are of a therapeutic nature, and therefore require a multitude of visits to health care providers. It is also difficult to make patients comply with suggested exercises for rehabilitation, as a means of prophylaxis.

Intersetmental traction refers to the slight mobilization of one joint relative to the next, in the spine for instance. Trigger point stimulation refers to the goading or rubbing of specific reflex points on the body. Many of these which are present in back and neck muscles are keys to relaxing muscles.

The incidence of back and neck pain is rising significantly around the world. In the United States alone an estimated 80 million Americans suffer from back pain. In response to the obvious need to quell this epidemic in which millions of dollars in worker productivity are lost weekly, this invention was conceived. It has the potential to greatly reduce the incidence and severity of back and neck disability.

Historically many devices have been attempted for the purpose of either strengthening the back, the neck, or for the mere purpose of administering a good massage. Some inventions were meant to produce only focal stimulation of trigger points within the muscles. A few devices were nearly successful in performing multiple functions, but in reality the designs either caused major functional flaws, or the cost of manufacture was prohibitive to widespread use.

This invention successfully combines back and neck massage with intersegmental traction, widespread trigger point therapy, and muscle rehabilitation in one cost effective device.

Known prior art does not include any inventions that fill this description. There does exist however some prior art with scattered similarities in structure. One such device incorporates the use of foam rubber balls mounted directly on axles, with no means of preventing unavoidable erosion of the core matrix of the ball, or to provide for free and smooth rotation while the user rolls across the balls as a massage. When these aspects are considered, as in U.S. Pat. No. 4,796,616 (Panahpour, 1989 smooth operation and practicality are lost as a result of the design. A few inventions made use of rigid axles upon which the roller device was mounted. These often call for the inclusion of journalled attachment to the supportive frame however, which necessarily increases the cost of production as well as the weight of the device. U.S. Pat. No. 4,688,556 (Keller, Jr. 1987) suggested a support frame holding oblate spheroids. These were only effective at mobilizing the vertebra themselves however, since the friction was centrally focussed by the shape of the rollers. It failed to produce trigger point therapy and was not practical for neck treatment.

All known prior art that is similar in function has significant drawbacks, making each impracticle for widespread use or production.

The following reasons are given for the failure of previous inventions to meet the obvious need which exists in this field:

a) previous inventions lacked smooth operation when design was applied to function
b) previous inventions were too heavy for practical home application, especially motorized models
c) previous inventions involved the use of special parts or difficult manufacture, therefore making cost impractical
d) previous inventions lacked durability by design
e) previous pro ducts lacked the versatility to treat multiple parts of the body simultaneously if so desired
f) previous inventions required the assistance of a skilled practitioner for use
g) none of the previous inventions known combines back and neck treatment effectively Obviously, all of these problems do not apply to every prior invention in this field. It is true however that the lack of commercial availability of such a device pays tribute to the impracticality of most devices introduced to date.

OBJECTS AND ADVANTAGES

Accordingly several objects and advantages of my invention are:

a) to provide a device that when properly used, will produce the combined effects of back and neck stimulation or massage, widespread trigger point therapy, intersegmental traction, and active rehabilitation;
b) to provide a device that can be produced relatively cheaply to insure more widespread availability at an affordable price;
c) to provide a device that when properly used, will alleviate back and neck pain, and also help to prevent return of such symptoms in the regular user;
d) to provide a device that will have a long useful life by virtue of the design and durable construction;
e) to provide a device that permits the option of treating the neck concurrently with the back if desired;
f) to provide a device that is light weight, portable, and compact enough to be easily stored away in small spaces such as a closet;
g) to provide a device that contributes to the rehabilitation of the back by strengthening the supportive muscles when used properly;
h) to provide a device that will have a smooth operation on most surfaces, while having a means for increasing resistance to glide for rehabilitation purposes;
i) to provide a device that will effectively support the head, with or without optional neck rollers;
j) to provide a device that will produce additional resistance to glide if desired;
k) to provide a device that will optimize the massage affect by virtue of the flexibility of the roller axles;
l) to provide an optional back pad for the increased comfort of the sensitive user;

m) to provide a device that can effectively stimulate difficult to reach, key trigger points by virtue of the round shape, variations in size, and strategic positioning and number of the roller elements Still further objects and advantages will become apparent from the ensuing description and drawings.

DESCRIPTION OF DRAWINGS

For a detailed description of a preferred embodiment of the invention, refer to the accompanying drawings.

In the drawings, closely related figures have the same number but different alphabetic suffixes.

REFERENCE NUMERALS IN DRAWINGS

12 Main Frame
14 Neck Roller Frame
16 Foam Rubber Back Roller Balls
18 Foam Rubber Neck Roller Balls
20 Foam Rubber Upper Back Roller Balls
22 Flexible Back Roller Ball Axle
23 Flexible Upper Back Roller Ball Axle
24 Rigid Neck Roller Axle
25 Flat Washer
26 Bushing
28 Locknut
30 Sleeve
32 Spacing Tube
34 Neck Roller Frame Suppert Wheel
36 Tension Adjustment Screw
38 Head Rest Pad
40 Neck Roller Frame Support Wheel
42 Neck Roller Frame Pins
44 Neck Roller Axle Retaining Bracket
46 Optional Resistence Leg Bands
47 Leg Band Hook
48 Leg Band Clasp
50 Optional Back Pad
52 Neck Roller Washer
53 Neck Roller Locknut
54 Neck Roller Axle Adjustment Slots

DESCRIPTION

Figure 1:
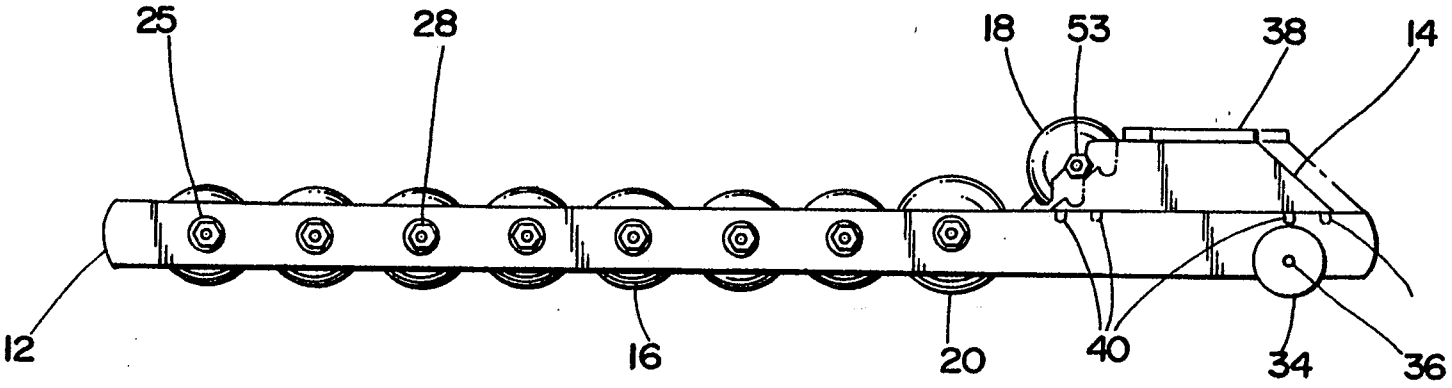
FIG. 1 shows a side elevational view of the main frame, neck roller frame, and relationship of balls to frame.
Figure 2A:
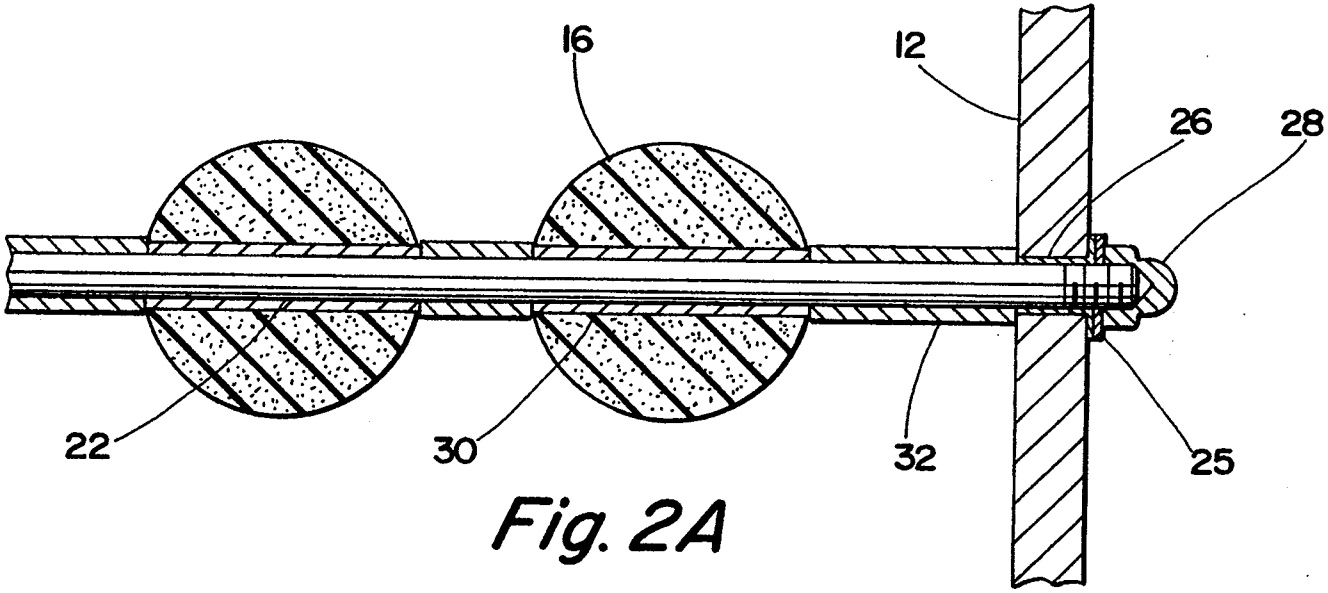
FIG. 2A shows an enlarged view of axle assembly consisting of bushings, roller balls, spacing tubes, axle, sleeves, flat washer and locknut, and their relationship to the main frame.
Figure 2:
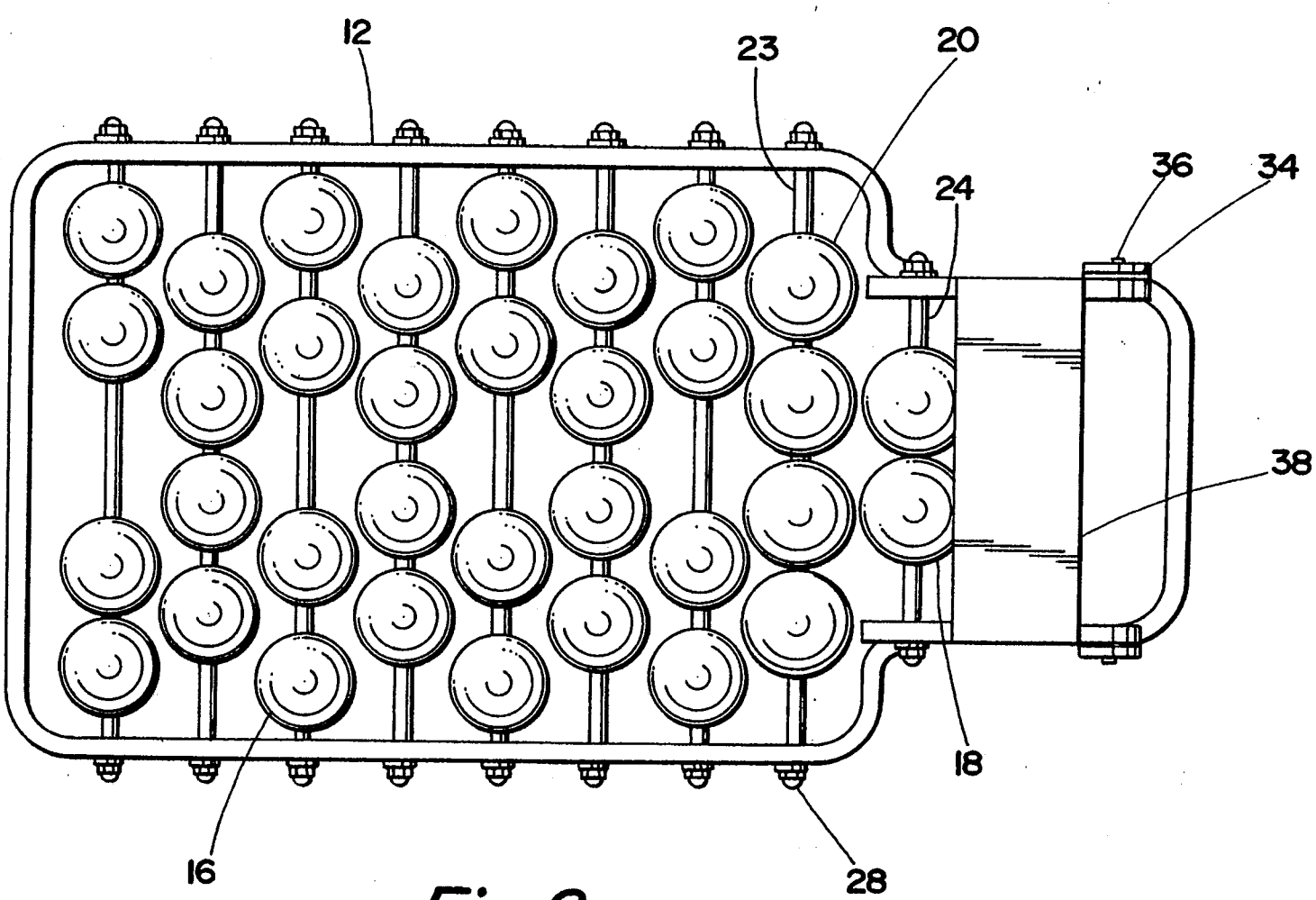
FIG. 2 shows a plan view of the invention with preferred placement of roller balls.

The preferred embodiment of the present invention is illustrated in FIG. 1 (elevational view), and FIG. 2 (plan view). It consists of a main frame 12 (FIG. 1) which is narrow enough in thickness to allow foam rubber back roller balls 16 to protrude significantly above and below it. Frame 12 must be slightly flexible for resilience, yet strong enough to resist major distortion over both the longitudinal and transverse axis. Frame 12 is somewhat rectangular in shape, having two distinct ends. The foot end has a large opening which houses a multitude of back roller balls 16 which are held in place on plurality of axles 22. The axles are supported transversely within the main frame 12 by the lateral sections of the main frame 12 and are secured by a flat washer 25 and a locknut 28 on the outside of main frame 12. A bushing 26 on each end of axle 22 assures free rotation while spacing tubes 32 maintain desired spacing of back roller balls 16 on axle 22.

Spacing tube 32 is placed over axle 22 between balls 16 and between ball 16 and frame 12. Ball spacing is controlled by relative lengths of tubes 32. Balls should be placed as specifically as possible so that maximum trigger point stimulation is achieved. Tube 32 should have an inside diameter large enough to rotate freely on axle 22 and an outside diameter larger than that of sleeve 30. Free rotation of tube 32 is also very important for smooth operation of completed assembly.

Back roller ball 16 has a centrally located hole through from one side to the other. Sleeve 30, having an outside diameter slightly larger than that of the hole is placed inside ball 16 so that the ends of sleeve 30 are flush with the outer radius of ball 16. Sleeve 30, having an inside diameter slightly larger than axle 22 is then slid onto axle 22, along with ball 16.

Smooth rotation of ball 16 on axle 22 should be noted. It is important that free and smooth rotation be insured both by balls on axles, and by axles within frame.

Upper back roller axle 23, being closest to the head end of main frame 12, should contain upper back roller balls 20, which are significantly larger than the back roller balls 16. Balls 20 are mounted on axle 23 a manner consistent with back roller balls 16. The increased relative size is important to insure proper contact with difficult to reach upper back trigger points. It is necessary for axle 23 to be mounted slightly higher than axles 22 in main frame 12. This will cause upper back roller balls 20 to lie flat on the floor with back roller balls 16 during use.

On the outside of frame 12 (FIG. 2) at the foot end are two optional resistence leg bands 46. These are fastened to frame 12 by means of an easily detachable, yet sturdy hook. The other end of leg bands 46 should be attachable to the ankles of the user. Leg bands 46 should be elastic and should also be adjustable for length permitting users of different height equal rehabilitation capabilities.

At the small end opening of main frame 12, head end, is mounted adjustable neck roller frame 14. It consists of a neck roller ball axle 24 which, unlike axle 22, is somewhat rigid. Neck roller balls 18 being approximately the same size as upper back roller balls 20, are mounted on axle 24 so that balls 18 are in close relationship to each other, and in the center of axle 24. Balls 18 are fitted with sleeve 30, and are freely rotatable like balls 16. Balls 18 are held together by spacing tubes 32 which are in turn held in place by neck roller washers 52 and neck roller locknut 53.

Figure 1A:
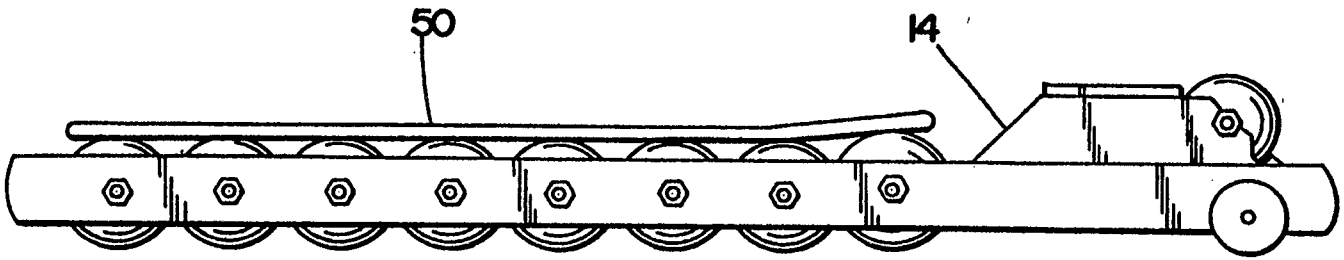
FIG. 1A is similar to FIG. 1 but shows the reversible neck roller frame in a non-treating position with consideration given to alternative placement in longitudinal axis.
Figure 1C:
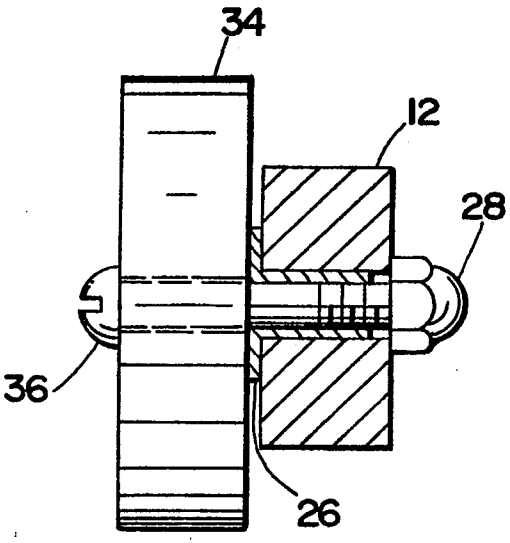
FIG. 1C shows tension adjusting screw controlling resistance of neck roller frame support wheel.
Figure 1B:
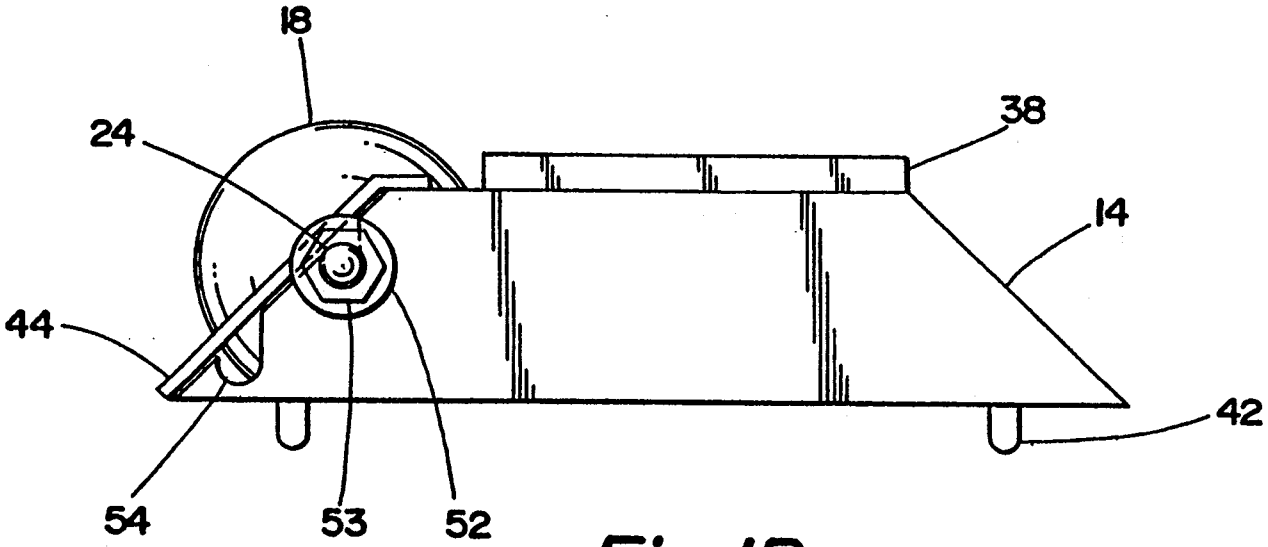
FIG. 1B shows an enlarged side elevation of the adjustable neck roller frame with consideration given to means of attachment to main frame.

Neck roller axle 24, is adjustable by means of locating it in different neck roller adjustment slots 54 (FIG. 1B). This makes neck treatment possible for different sized individuals. Axle 24 is kept in place during use by neck roller axle retaining bracket 44 which is held in place by a hinge on one end, and a snap mechanism on the other end.

Headrest pad 38 is fastened to the top of frame 14 just beyond adjustable neck roller axle 24.

Frame 14 is adjustable in longitudinal position on main frame 12 by positioning neck roller frame pins 42 in different sets of neck roller frame adjustment holes in main frame 12. Neck roller frame 14 (FIG. 1A) can also be turned 180 degrees about the vertical axis so that back treatment can be accessed without neck roller treatment if so desired.

Neck roller frame support wheel 34 (FIG. 1C) is attached to each side of head end of main frame 12 so that it supports the weight of the head and neck during use. This permits smooth movement of device over floor or other operating surface. Wheel 34 is fastened to main frame 12 by tension adjusting screw 36, which controls ease of glide during use by increasing or reducing friction.

Optional back pad 50 (FIG. 1A) can be used to decrease pressure of roller balls on back for sensitive users.

From the description above a number of advantages of my invention become evident:

a) The number, relative size, shape, and placement of the foam rubber balls improves accuracy and completeness of stimulation of back muscle trigger points over previous self massage inventions.
b) The invention is compact and light-weight, and can easily be produced at a low cost from readily available materials.
c) Smooth action and durability are assured by the strategic placement of sleeves and axles.
d) Additional massage action is provided by longitudinal movement of flexible axles used for the back rollers.

OPERATION—FIGS. 3 AND 3A

Figure 3:
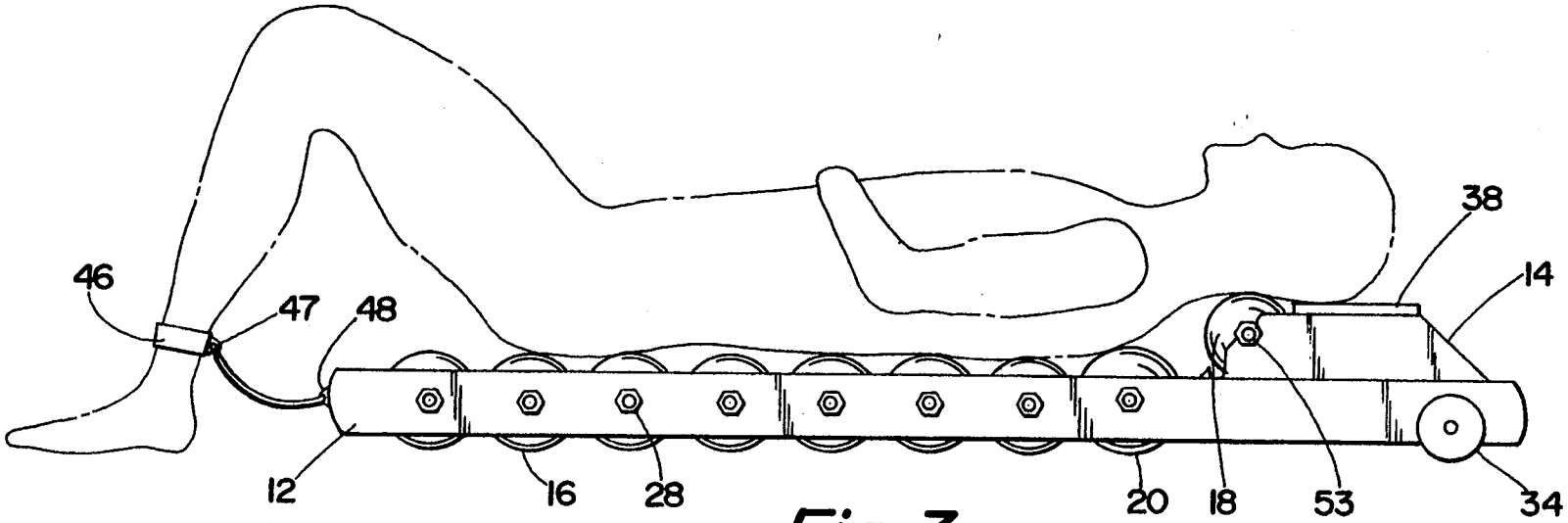
FIG. 3 shows preferred method of treatment with user's legs in flexed or starting position.
Figure 3A:
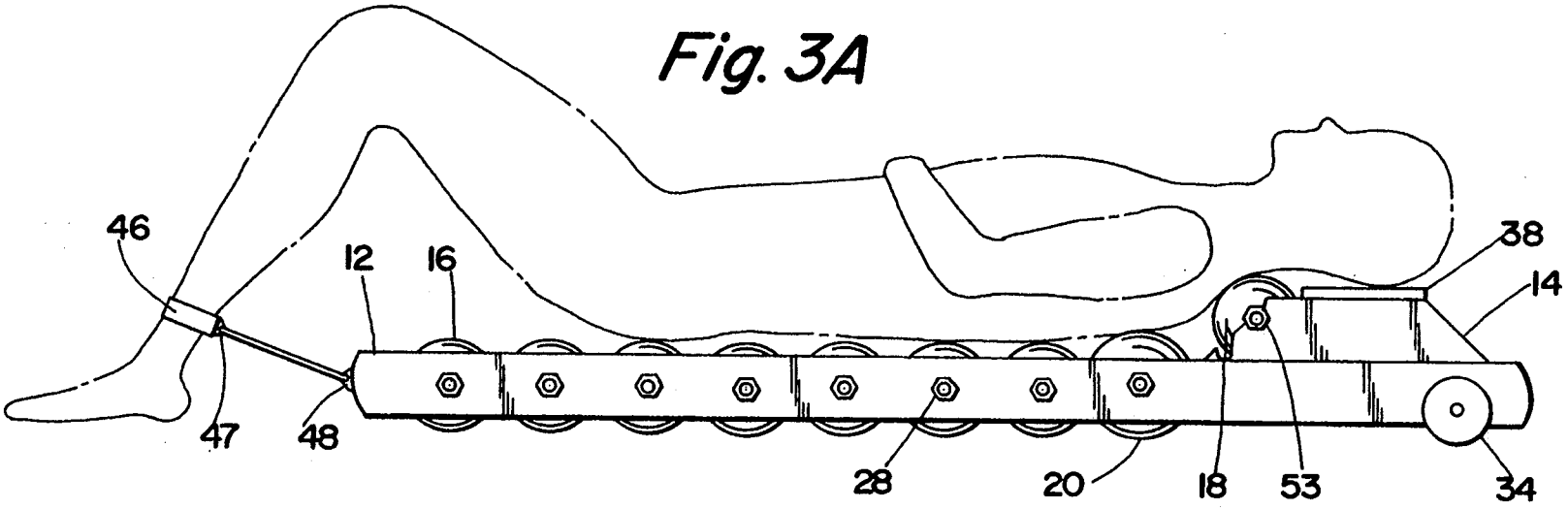
FIG. 3A shows user in finish position after completion of first movement in treatment, legs extended.
Figure 4:
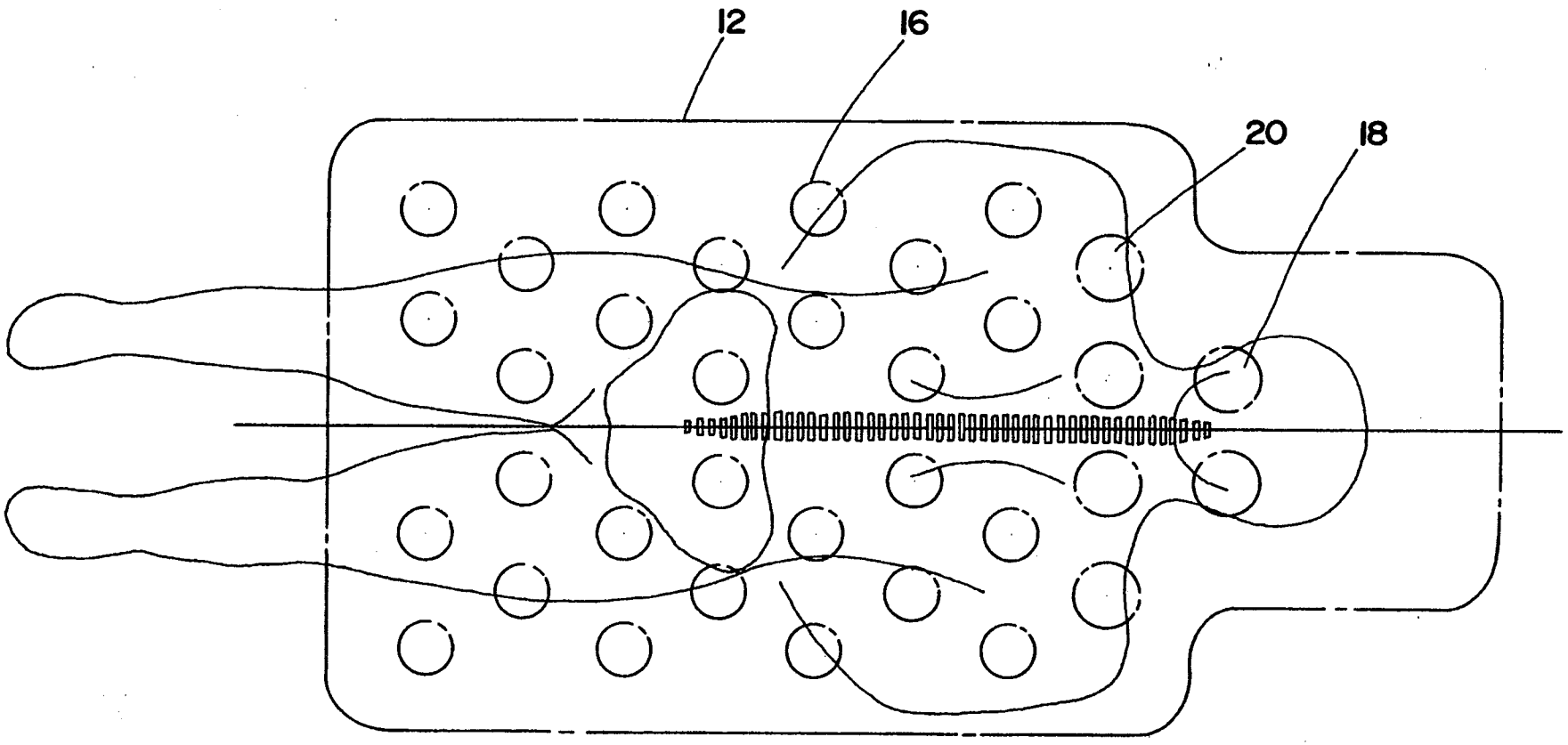
FIG. 4 shows body contact points of roller balls in preferred positions.

The methods for using this invention are illustrated in FIGS. 3 and 3A. By lying on his or her back upon the roller balls 16, the user feels multiple points of pressure on muscles and spinal structures. With the legs in a bent position and the feet placed flat on the floor, the lumbar spine is automatically flattened against roller balls 16, increasing contact area. The upper back is contacting upper back roller balls 20 in such a way as to cause pressure on key trigger points located there. The neck falls back over neck roller balls 18 in a cradling manner between them, with the head resting comfortably on head rest pad 38.

By slowly causing the legs to straighten the user pushes his or her body over the rollers and the neck through neck roller balls 18. The legs are then flexed slowly causing the user and the device to move in the opposite direction, applying stimulation to various parts of the back and neck.

Exercise is provided to the various supportive muscles of the back by the repetitious motion of the legs. This represents isotonic exercise. The optional neck roller balls also present the opportunity to produce isometric exercise of the abdominal muscles. This is accomplished simply by the user holding his or her head up during use. Resistence to leg extension can be increased by use of optional resistence leg bands 46. This accounts for much of the rehabilitation effect.

The surprising result is that while the user is enjoying an invigorating back and neck massage the benefit of exercise is an unexpected bonus. Also, somewhat of a surprise is that by using multiple balls for the stimulation effect three things happen:

1) Weight of the user is more widely dispersed therefore allowing a softer ball to be used.
2) Stimulation can be focused more specifically on a wide distribution of trigger points.
3) The open space between the balls creates effective intersegmental traction on the joints of the spine and back.

SUMMARY, RAMIFICATIONS AND SCOPE

Accordingly, the reader will see that proper use of this invention will produce a full back and neck massage, intersegmental traction of the spine and associated joints and stimulation of a multitude of trigger points, and active rehabilitation of key muscles with little noticeable effort. Furthermore, additional advantages are:

light weight, compact design permits ease of storage
design for both smooth action and durability
readily available components decrease cost
versatility for different treatments at once
fulfills a need in modern society in helping reduce the cost and occurrence of back pain Although the description above contains many specifications, these should not be construed as limiting the scope of this invention but as merely providing some illustrations of presently preferred embodiments.

For example the foam rubber roller balls can be smooth, or have a roughened surface to produce more friction on the back of the user. The foam rubber balls are preferably of a medium soft density, but variations in density may be used. Different materials might be used for bushings and sleeves. The overall shape of the main frame might also be changed for appearance purposes.

Thus the scope of this invention should be determined by the appended claims and their legal equivalents, rather than by the examples given.

The teachings of the present invention have substantial utilities for those tens of millions of people suffering with back and neck pain.

What is claimed:

1. A combined back and neck stimulation device comprising:

a) a thin substantially rectangular main frame having a head end and being of sufficient size to accomodate a human body in the supine position;
b) a plurality of flexible roller ball axles which are substantially smooth, transversely mounted within said rectangular main frame;
c) a plurality of backroller balls which are attached to said back roller axles such that the balls can rotate;
d) the centers of said back roller balls exist in a singular plane in which the plane has an upper surface and a lower surface, wherein the lower most surface of the device is defined by the outer most surface of the back roller balls such that the device will be able to roll along a surface;
e) a neck roller frame located at the head end of said main frame;
f) a head rest attached to said neck roller frame;
g) said head rest comprising a generally planar surface;
h) a pair of neck roller balls attached to the headrest, the centers of the neck roller balls are at a substantial vertical distance away from the upper surface of the plane containing the center of the back roller balls, whereas said neck roller balls constitute a means of axial elongation of the spine during use of the device.

2. The combined back and neck stimulation device of claim 1 wherein said neck roller balls are provided with a means for easy removal and replacement on said neck roller frame.

3. The combined back and neck stimulation device of claim 1 wherein said neck roller balls and said back roller balls are made of a material from the foam rubber group.

4. The combined back and neck stimulation device of claim 1 wherein said neck roller frame is supported by at least one neck roller support wheel with a mounting means on the underside of said neck roller frame.

5. The combined back and neck stimulation device of claim 1 wherein size and weight are relatively compact and minimal thereby making device portable.

6. The combined back and neck stimulation device of claim 1 wherein said neck and back roller balls are provided a means for free rotation about said roller ball axles.

7. The combined back and neck stimulation device of claim 1 wherein said neck roller frame support wheels have a tension adjustment screw.

8. The combined back and neck stimulation device of claim 1 wherein said back roller balls are staggered in their alignment.

9. The combined back and neck stimulation device of claim 1 wherein said back roller ball axles provide a support means to maintain said main frame above operating surface while in use.

10. The combined back and neck stimulation device of claim 1 wherein said main frame and said neck roller frame are one piece and is from the plastics group.

* * * * *